United States Patent [19]

Take et al.

[11] Patent Number: 4,780,180

[45] Date of Patent: Oct. 25, 1988

[54] NONFLAMMABLE PAPER

[75] Inventors: Takao Take; Kentaro Nakahara, both of Chiba; Katsuaki Kaneko, Tokyo, all of Japan

[73] Assignees: Onoda Cement Co. Ltd., Ymaguchiken; Meisei Chemical Works Ltd., Kyototu, both of Japan

[21] Appl. No.: 133,386

[22] Filed: Dec. 15, 1987

Related U.S. Application Data

[63] Continuation of Ser. No. 888,341, Jul. 23, 1986, abandoned.

[30] Foreign Application Priority Data

Jul. 16, 1985 [JP] Japan ..... 60-165542

[51] Int. Cl.[4] ..... D21H 3/66

[52] U.S. Cl. ..... 162/145; 162/146; 162/158; 162/159; 162/181.4; 162/181.6

[58] Field of Search ..... 162/145, 146, 159, 181.6, 162/181.4, 158; 106/18.12, 18.26; 252/607; 428/921

[56] References Cited

U.S. PATENT DOCUMENTS

| | | | |
|---|---|---|---|
| 2,888,377 | 5/1959 | Allen | 162/181.6 |
| 2,917,426 | 12/1959 | Bugosh | 162/145 |
| 3,117,944 | 1/1964 | Harrell | 162/181.6 |
| 4,095,985 | 6/1978 | Brown | 106/18.12 |
| 4,371,579 | 2/1983 | McCaskey et al. | 162/181.6 |

FOREIGN PATENT DOCUMENTS

| | | | |
|---|---|---|---|
| 565592 | 11/1958 | Canada | 162/145 |
| 84/02727 | 7/1984 | PCT Int'l Appl. | 162/181.6 |
| 2051170 | 1/1981 | United Kingdom | 162/145 |

*Primary Examiner*—Peter Chin
*Attorney, Agent, or Firm*—Fred Philpitt

[57] ABSTRACT

A nonflammable paper having a sufficient yield at the time of paper-making and a sufficient non-combustibility and strength even in a basis weight as low as 100 $g/m^2$ or less is provided, which paper is obtained by dispersing in water a composition comprising 40 to 95% by weight of calcium silicate in the form of needle, plate, thin film or a secondary aggregate thereof, and aluminum hydroxide powder, in a specified ratio by weight, 5 to 30% by weight of cellulose fibers and 0 to 30% by weight of other additives, the total weight of these components being 100% by weight, followed by subjecting the dispersion to paper-making.

6 Claims, No Drawings

NONFLAMMABLE PAPER

BACKGROUND OF THE INVENTION

1. Field of the Invention

This invention relates to a nonflammable paper, particularly a nonflammable paper having a low basis weight.

2. Description of the Prior Art (1) Nonflammable paper and fire-retardant paper so far used include an asbestos paper composed mainly of asbestos and a paper obtained by subjecting usual pulp as raw material to paper-making, followed by treatment with various flame-retardants. The former has superior properties such as heat resistance, chemical resistance, etc., but on the other hand, since asbestos has been regarded as a substance causing lung cancer, a severe regulation has come to be carried out.

On the other hand, in the case of the latter, since it generates a poisonous gas or fuming at the time of its ignition, a serious problem has been raised in the aspect of safety.

(2) In recent years, nonflammable papers using a material of non-pollution-nuisance have come to be desired, and in accordance with this desire, a nonflammable paper composed mainly of aluminum hydroxide has been developed.

The aluminum hydroxide paper has non-combustibility, non-pollution-nuisance, self-extinguishing properties, high brightness, etc., whereas in the case of a low basis weight, particularly in the case of 120 g/m$^2$ or less, it has had drawbacks that the yield at the time of paper-making lowers and also the strength and non-combustibility lower to a large extent to make it impossible to obtain a product which is endurable to use as a nonflammable paper.

(3) Recently, a nonflammable paper composed mainly of calcium silicate has been developed (Japanese patent application laid-open No. Sho 58-98495/1983), but since calcium silicate hydrate has a high dehydration temperature, there is a drawback that it is inferior in non-combustability. Thus, in order to obtain a sufficient non-combustibility (flameproofness, first grade), it is necessary to make the mixing proportion of pulp 5% or less. As a result, when the basis weight is made 100 g/m$^2$, the tensile strength becomes as notably low as about 0.5 Kg/15 mm, that is, does not reach the practical strength of paper.

SUMMARY OF THE INVENTION

In order to overcome the drawbacks of aluminum hydroxide paper and calcium silicate paper as the prior art, that is, the problems that when the basis weight is as low as 100 g/m$^2$ or less, the yield at the time of paper-making is reduced and also the strength and non-flammability of the resulting paper are reduced, the present inventors have made extensive research, and as a result have found that when a composition comprises 40 to 95% by weight in total of calcium silicate in the form of needle, plate, thin film or a secondary aggregate thereof and aluminum hydroxide powder, in a ratio by weight within a range of 2:8 to 8:2, 5 to 30% by weight of cellulose fibers and 0 to 30% by weight of other additives, the total weight of these components being 100% by weight, then it is possible to obtain a nonflammable paper having a sufficient yield at the time of paper-making and a sufficient non-combustibility and strength, even in the case of a basis weight as low as 100 g/m$^2$ or less.

The present invention resides in a nonflammable paper obtained by dispersing in water a composition comprising (1) 40 to 95% by weight of a component composed of calcium silicate and aluminum hydroxide powder in a ratio by weight in the range of 2:8 to 8:2, (2) 5 to 30% by weight of cellulose fibers and (3) 0 to 30% by weight of other additives, said calcium silicate being composed mainly of $CaO\text{-}SiO_2\text{-}H_2O$, having a molar ratio of $CaO/SiO_2$ thereof in the range of 1:2 to 2:1 and having a crystalline form of needle, plate, thin film or a secondary aggregate thereof, the respective percentages by weight of the components (1), (2) and (3) being based on the weight of the resulting composition, followed by subjecting the resulting dispersion to paper-making.

DETAILED DESCRIPTION OF PREFERRED EMBODIMENTS

The specific feature of the present invention in the aspect of raw material consist in that calcium silicate in the crystal form of needle, plate, thin film or a secondary aggregate thereof, obtained by hydrothermal preparation, is simultaneously used with aluminum hydroxide. The aluminum hydroxide is in the form of fine powder, and a suitable retention aid is added thereto to form flock, whereby it is held by fibers such as pulp and subjected to paper-making. In this case, with decrease in the basis weight, the proportion in which it is held lowers to reduce the yield at the time of paper-making.

Whereas, when the above-mentioned calcium silicate is simultaneously used, the aluminum hydroxide particles are held by the calcium silicate aggregate and the resulting aggregate is made into paper along with fibrous substances containing cellulose; hence the yield is not reduced even in a low basis weight, and also the resulting product has a sufficient strength due to a firm bond among aluminum hydroxide-calcium silicate-fibers.

Aluminum hydroxide referred to herein is expressed by a chemical formula $Al(OH)_3$, and usually, it is in the form of white powder having a purity of 99% or higher. Aluminum hydroxide having a large particle size hinders the surface smoothness of paper and also the strength of paper is reduced; thus its average particle diameter is 50$\mu$ or less, preferably 15$\mu$ or less.

Calcium silicate referred to herein is composed mainly of $CaO\text{-}SiO_2\text{-}H_2O$, and if the molar ratio of $CaO/SiO_2$ is in the range of 1:2 to 2:1, there is no particular limitation to its kinds such as wollastonite group, tobermorite group, gyrolite group, etc. Its form may be any of those of needle, plate, thin film and a secondary aggregate thereof. However, calcium silicate having no specific feature as described above in the aspect of form such as C-S-H gel is excluded from the object of the present invention.

The effectiveness of the calcium silicate used in the present invention consists univocally in the holding properties relative to aluminum hydroxide; hence as its specific feature in the aspect of form, those in the form of needle and/or its secondary aggregate are preferred.

When the nonflammable paper of the present invention is produced using the calcium silicate as raw material, the calcium silicate is preferred to have free water in a quantity of twice or more, preferably five times or more the weight of the solids content. In the case where calcium silicate is excessively dehydrated by compression, heating or the like, even when the resulting composition is again dispersed in a large quantity of water and paper-making is carried out, the effectiveness of holding aluminum hydroxide particles is reduced; hence the yield at the time of paper-making is reduced.

The ratio by weight of calcium silicate to aluminum hydroxide is in the range of 2:8 to 8:2. If the proportion of calcium silicate is too small, the above holding properties relative to aluminum hydroxide lower to reduce the yield at the time of paper-making; hence the product of the present invention cannot be obtained.

On the other hand, if the appropriate of aluminum hydroxide is too small, the strength of the resulting product lowers and also its self-extinguishing properties i.e. non-combustibility lowers.

The proportion by weight of the total quantity of calcium silicate and aluminum hydroxide is required to be in the range of 40 to 95%. If the proportion is less than 40% by weight, it is impossible to ensure a sufficient non-combustibility. If it exceeds 95% by weight, the quantity of fibers is reduced as much so that the specific feature in the form of paper is lost. The total quantity of calcium silicate and aluminum hydroxide is preferred to be in the range of 55 to 85% by weight, in both the aspects of physical properties and non-combustibility in the form of paper.

The paper of the present invention comprises besides the above calcium silicate and aluminum hydroxide, fibrous substances and other additives, and the total quantity of the latter two is required to be in the range of 5 to 60% by weight, and further it is an indispensable requirement that the quantity of cellulose fibers contained therein is in the range of 5 to 30% by weight. The presence of cellulose fibers is not only necessary for paper-formation, but also ensures specific features of paper such as strength, flexibility, pliability, etc. and attributes to improvement in the yield at the time of paper-making; hence it is indispensable for the constitution of the present invention, but since the fibers are combustible, the non-combustibility of the resulting paper lowers with increase in the proportion of the fibers. Thus the content of the fibers is limited to a range of 5 to 30% by weight.

As fibrous substances other than cellulose, any of organic fibers such as polyamide fibers, polyester fibers, etc., and any of inorganic fibers such as glass fibers, rock wool, ceramic fibers, natural acicular wollastonite, etc. may be used, but in the sense of retaining non-combustibility, the total quantity of cellulose fibers and organic fibers is preferred to be 30% by weight or less. Further, when glass fibers are used as inorganic fibers, the yield at the time of paper-making is improved and further, due to increase in the wet strength of paper, peeling off from wire is improved; thus it is preferred to use e.g. 5 to 30% by weight of glass fibers as a portion of fibers.

In order to further improve the yield at the time of paper-making in the production of the product of the present invention, it is also possible to use a retention aid. As the retention aid an anionic, cationic or anionic-cationic-combined, macromolecular flocculant may be used, and its quantity added is usually in the range of 0.5 to 5% by weight as calculated from the weight of the solids content. The paper-making conditions and the paper-making processes may be conventional ones.

Further, in accordance, with objects, various kinds of quality improvement agents as the additives can be mixed, impregnated or applied, and as such quality improvement agents, a paper strength-reinforcing agent, an agent for flame-retardant treatment, a waterproofing agent, a coloring agent, a filler for imparting luster or lubricating properties, etc. may be blended.

The proportion by weight of the total quantity of fibrous substances containing cellulose fibers and other additives is in the range of 5 to 60% by weight, preferably 15 to 45% by weight.

Further, in the production of the nonflammable paper of the present invention, predetermined proportions of calcium silicate, aluminum hydroxide, fibrous substances containing cellulose fibers and other additives are uniformly dispersed in a large quantity of water and made into paper in a conventional manner.

Thus, the nonflammable paper of the present invention exhibited e.g. a strength as high as 1.17 Kg/15 mm in terms of the tensile strength (MD) according to JIS R-8113 in a basis weight of produced paper of 70 g/m$^2$ and passed the first grade of flameproofness in the test of fire-retardant properties according to JIS A-1322, as shown in Table 1 in Example.

The paper obtained according to the present invention is a nonflammable paper which is produced using safe inorganic materials containing no substance harmful to human body or generating no poisonous gas when heated to give a practically sufficient strength in a low basis weight, so far not obtained, and passes the test of fire-retardant properties. As a result, the paper has come to be not only broadly applicable to wall paper, fusuma paper ("fusuma", a Japanese word, means a kind of sliding doors), shohji paper ("shohji", a Japanese word, also means a kind of sliding doors), backing paper for vinyl cloth, vinyl floor material, building materials for interior such as ceiling surface material, to be made non-combustible, but also applicable to surface material for air conditioning duct, filter of heat insulation material, fire resistant covering material, paper for securities, etc.

The present invention will be described in more detail by way of Example, but it should not be construed to be limited thereto.

EXAMPLE

Raw materials used and testing methods of paper are as follows:

- Calcium silicate (Xonotlite) (1): Calcium silicate in the form of a slurry having a solids content of 5% by weight, obtained by hydrothermal preparation. It was mostly in the form of fine acicular crystals and their aggregate, and as a result of X-ray diffraction, it was mostly xonotlite
- Aluminum hydroxide: Purity, 99.7%. Average particle diameter 4μ. (Manufactured by Nippon Light Metal Co., Ltd.).
- Glass fiber: E glass. Cut length, 3 mm.
- Pulp: A product obtained by beating so as to give a LBKP/NBKP ratio of 8/2 and a Canadian standard freeness of 350 cc.
- Retention aid: Anionic; Filex M, tradename of product manufactured by Meisei Chemical Works, LTD. Cationic; Filex RC107, tradename of product manufactured by Meisei Chemical Works, LTD.
- Tensile strength: according to JIS P 8113
- Brightness: according to JIS P 8123
- Opacity: according to JIS P 8138
- Air resistance: according to JIS P 8117

Flame-retardant properties: according to JIS A 1322. 45° Méker burner method. Heating time, 3 minutes.

The above-described calcium silicate and aluminum hydroxide, and pulp, glass fibers and retention aid in determined quantities shown in Table 1 were dispersed in water and subjected to paper-making by means of a paper machine for test in a conventional manner, followed by pressing and drying to obtain paper. The specific features of the thus obtained paper and the yield at the time of paper-making are also shown in Table 1.

The conditions of the aimed values of physical properties of paper consist in that the yield at the time of paper-making is 80% or higher in a basis weight of produced paper as low as 100 g/m$^2$ or less; the breaking length is 1 Km or more; the paper passes the first grade of flameproofness in the test of fire-retardant properties; further no trouble occurs in the paper-making process; and the paper formation of the produced paper is superior.

TABLE 1

| Test No. | Proportion of raw materials (% by weight) Calcium silicate | Aluminum hydroxide | Pulp | Glass fibers | Retention aid (% by weight based on raw material) Anionic | Cationic | Basis weight of produced paper g/m$^2$ | Yield of paper-making % | Tensile strength Kg/15 mm | Breaking strength Km | Judgement of flame-retardant properties (flame-proofness 1st grade) | Note |
|---|---|---|---|---|---|---|---|---|---|---|---|---|
| 1 | 80 | | 20 | | 1 | 1.5 | 92 | 86 | 0.67 | 0.49 | x | |
| 2 | 70 | | 20 | 10 | " | " | 90 | 92 | 0.98 | 0.73 | x | |
| 3 | 95 | | 5 | | " | " | 85 | 83 | 0.17 | 0.13 | o | |
| 4 | 80 | | | 20 | " | " | 73 | 76 | 1.06 | 0.97 | o | Paper is broken by bending |
| 5 | | 80 | 20 | | " | " | 55 | 57 | 0.36 | 0.44 | o | Many pin-holes; limp |
| 6 | | 70 | 20 | 10 | " | " | 69 | 67 | 0.78 | 0.75 | o | Many pin-holes; limp |
| 7 | | 70 | 30 | | " | " | 76 | 69 | 1.26 | 1.11 | x | Many pin-holes; limp |
| 8 | 50 | 20 | 20 | 10 | " | " | 70 | 91 | 1.17 | 1.11 | o | |
| 9 | 35 | 35 | 20 | 10 | " | " | 80 | 88 | 1.20 | 1.00 | o | |
| 10 | 50 | 10 | 30 | 10 | " | " | 90 | 96 | 1.78 | 1.32 | x | |
| 11 | 20 | 50 | 20 | 10 | " | " | 60 | 79 | 1.02 | 1.13 | o | |
| 12 | 20 | 50 | 20 | 10 | " | " | 74 | 89 | 1.11 | 1.00 | o | |
| 13 | 50 | 20 | 20 | 10 | " | " | 86 | 92 | 1.60 | 1.24 | o | |
| 14 | 50 | 30 | 20 | 0 | " | " | 84 | 87 | 1.17 | 0.93 | o | Weak wet strength; bad peeling-off from wire |

As shown in Table 1, in the case of combinations of calcium silicate with fibers shown in test Nos. 1–4, if the content of pulp is 20% or more, the resulting paper does not pass the first grade of flameproofness, while the content of pulp is reduced, the strength thereof lowers. In the combination of calcium silicate with glass fibers, non-combustible properties are superior, but a drawback occurs that when the paper is bent, it is broken; hence the paper is not in the form of real paper.

In the case of combinations of aluminum hydroxide with fibers shown in test Nos. 5–7, if the basis weight is low, the yield is as low as 70% or less and the strength is also low. In addition, many pinholes are observed in the produced paper and the paper is almost limp. Whereas, the paper of the present invention generally satisfies the aimed physical properties, as shown in test Nos. 8, 9, 11, 12, 13 and 14. However, in the case of test No. 14, since no glass fiber is added, there are drawbacks that the wet strength of the paper is low and peeling-off from wire is inferior, and the yield and the strength are both somewhat lower than those in test No. 13. In the case of test No. 10, since the ratio of calcium silicate/aluminum hydroxide exceeds the range of the present invention, that is, the quantity of aluminum hydroxide is too small, the paper did not pass the first grade of flameproofness in a pulp content of 30%.

What we claim is:

1. A nonflammable paper obtained by dispersing a composition in water followed by making the resulting dispersion into paper, said composition consisting essentially of:

(a) 40–95% by weight of a calcium silicate-$Al(OH)_3$ powder, the ratio of the calcium silicate to $Al(OH)_3$ powder being in the range of 2:8 to 8:2, (b) 5–30% by weight of cellulose fibers, said calcium silicate being mainly composed of $CaO$-$SiO_2$-$H_2O$ and the molar ratio of $CaO/SiO_2$ thereof being in the range of 1:2 to 2:1, said calcium silicate being crystalline and in the form of needles, plates, thin films or secondary aggregates, and said $Al(OH)_3$ powder having an average particle size of 50$\mu$ or less.

2. A nonflammable paper obtained by dispersing a composition in water followed by making the resulting dispersion into paper, said composition consisting essentially of (a) 40–95% by weight of a calcium silicate-$Al(OH)_3$ powder, the ratio of the calcium silicate to $Al(OH)_3$ powder being in the range of 2:8 to 8:2, (b) 5–30% by weight of cellulose fibers, (c) 0–30% by weight of at least one additive selected from the group consisting of polyamide fibers, polyester fibers, glass fibers, rock wool, ceramic fibers and natural acicular wollastonite, and (d) 0–30% by weight of at least one quality-improving agent selected from the group consisting of wet-strength-reinforcing agents, fire-retardants, waterproofing agents, coloring agents and agents for imparting luster or lubricating properties, the total weight of (c) and (d) being 0–30% by weight based on the total weight of the composition, said calcium silicate being mainly composed of $CaO$-$SiO_2$-$H_2O$ and the molar ratio of $CaO/SiO_2$ thereof being in the range of 1:2 to 2:1, said calcium silicate being crystalline and in the form of needles, plates, thin films or secondary aggregates, and said $Al(OH)_3$ having an average particle size of 50μ or less.

3. A nonflammable paper according to claim 2 wherein the total quantity of said cellulose fibers and said at least one additive (c) is in the range of 5 to 60% by weight based on the total weight of the composition.

4. A nonflammable paper according to claim 2 wherein the total quantity of said cellulose fibers and said at least one additive is in the range of 15 to 45% by weight based on the total weight of the composition.

5. A nonflammable paper according to claim 2 wherein said at least one additive is composed of glass fibers and its quantity is in the range of 5 to 30% by weight based on the total weight of the composition.

6. A nonflammable paper according to claim 2 wherein said at least one additive is composed of polyamide fibers or polyester fibers and the total quantity of said cellulose fibers and said polyamide fibers or said polyester fibers is 30% by weight or less based on the total weight of the composition.

* * * * *